United States Patent [19]

Brzozowski

[11] Patent Number: 4,813,244

[45] Date of Patent: Mar. 21, 1989

[54] HYDRAULICALLY ACTUATED CRYOGENIC LEADS

[75] Inventor: Steven J. Brzozowski, Scotia, N.Y.

[73] Assignee: General Electric Company, Schenectady, N.Y.

[21] Appl. No.: 109,650

[22] Filed: Oct. 19, 1987

[51] Int. Cl.[4] ..... F25B 19/00

[52] U.S. Cl. ..... 62/514 R; 439/190; 439/435

[58] Field of Search ..... 62/514 R; 439/190, 435

[56] References Cited

U.S. PATENT DOCUMENTS 4,614,393 9/1986 Laskaris ..... 439/435

4,635,450 1/1987 Laskaris ..... 62/514 R

*Primary Examiner*—Ronald C. Capossela

*Attorney, Agent, or Firm*—William H. Steinberg; James C. Davis, Jr.; Paul R. Webb, II

[57] ABSTRACT

Retractable cryogenic leads for superconducting magnets are provided for making low resistance contacts at liquid helium temperature reliably in the presence of heavy frost. A tube defining a bayonet socket on one end extends through a vertical stack cover of a cryostat insert to engage and disengage a vertical terminal rod having a transverse pin. A copper rod is slidable mounted inside the tube and is vertically displaced relative to the tube by a hydraulic actuator having a housing secured on the other end of the tube. A piston is slidably mounted in the housing. After the bayonet socket engages the pin of the vertical terminal rod, the piston when extended from the housing can force the copper rod against the top of the vertical terminal rod.

10 Claims, 4 Drawing Sheets

16
36
87
40
39
38
63
37
43
47
41
11
45
45
12
21
27
23
31
23
13
16
17
35
15
61
33
57

HYDRAULICALLY ACTUATED CRYOGENIC LEADS

BACKGROUND OF THE INVENTION

The present invention is generally directed to mechanical devices for making secure electrical connections to superconductive coils disposed within cryostats.

In the generation of images in medical magnetic resonance diagnostic systems, it is necessary to provide a temporally stable and spatially homogeneous magnetic field. The use of superconductive electrical materials maintained at a temperature below their critical transition temperatures provides an advantageous means to produce such a field. Main superconductive electrical coil windings are disposed in a vessel containing a cryogenic fluid such as liquid helium. Main coils and correction coils which provide the desired magnetic field uniformity are disposed in a cryostat which is essentially a thermal insulating device. The superconductive windings exhibit the particular advantage that electrical energy need not be supplied to the circuit once the desired current level is achieved in the main coils and the correction coils. However, electrical connections must be made to these interior coils at various intervals such as in the case of initial startup or after a quench condition in which the superconductive windings undergo a transition to the normal, that is, resistive state and the current flow is dissipated. In superconducting magnets, the main magnet coils can carry a current of 2,000 amperes while the correction coil currents are typically no more than 50 amperes.

While the correction coils and the main magnet coils typically comprise superconductive material, circuit energization is generally accomplished by means of normal (nonsuperconducting) conductors, which penetrate the nested set of vessels of the cryostat and significantly impair their insulating function or increase the rate of helium evaporation. It is desirable therefore to make and break electrical connections at superconducting temperatures, to minimize helium boiloff in steady state operation when the leads are retracted. Because of the extremely low temperatures (4° K.) at which the connections are made and broken, there is a very strong tendency for frost to form on the electrical contacts. This frost typically includes both ice and solidified air. This frost, whether ice, air or both, can significantly impede the formation of a good electrical connection between the interior magnet circuit and an exterior energizing source. Electrical and mechanical properties of the contact surfaces must be adequate at the cryogenic temperatures since a high resistivity contact junction will generate heat and unnecessarily boil off cryogenic coolants.

A cam lever mechanism for a retractable lead system is described in U.S. Pat. No. 4,614,393 and assigned to the instant assignee. The cam lever mechanism tightens a split-ring terminal around the leads to exert high pressure at the contacts. One of the mating surfaces is serrated and preferably silver plated, and the other is coated with a thick layer of soft metal such as indium. Wear of the cam and linkages in the low temperature environment is a concern with regard to the life and reliability of the device especially when it is inaccessible for maintenance or repair.

Compact retractable cryogenic leads using a bayonet socket arrangement are described in U.S. Pat. No. 4,635,450, assigned to the same assignee as the present invention.

The retractable lead assembly comprises a tube defining a bayonet socket at one end and means for slidably and rotatably disposing the tube through the cryostat aperture. The tube extends inside and outside the cryostat with the bayonet end of the tube extending inside the cryostat. An electrically conductive rod is slidably disposed inside the tube. An electrically conductive terminal post with a transverse pin adapted to be engaged by the bayonet socket is mounted in the cryostat. Means external to the cryostat for rotating and slidably moving the tube to engage and disengage the socket with the terminal post are affixed to the tube. A threaded actuator external to the cryostat is coupled to the rod and the tube for adjusting the relative displacement between the rod and the tube, so that the rod can be urged against the post after the socket engages the pin. In operation, the threaded actuator can fail to apply a consistent load at the contact interface due to the presence of frost that accumulates at the warm end of the vapor cooled leads. This inconsistency can result in a high resistance contact or worse, the mechanical failure of inaccessible components.

It is an object of the present invention to provide a compact arrangement for high contact force electrical connections that can be operated by means of accessible, ambient-temperature, mechanical components.

It is another object of the present invention to provide high current leads that can make and break contact repeatedly and still attain a low resistivity connection.

It is a further object of the present invention to provide hydraulically actuated cryogenic leads which are easily disengageable and removable from a superconducting magnet as required.

SUMMARY OF THE INVENTION

A retractable lead assembly is provided for a cryostat having an aperture. The retractable lead assembly comprises a tube defining a bayonet socket at one end and means for slidably and rotatably disposing the tube through the cryostat aperture. The tube extends inside and outside the cryostat with the bayonet end of the tube extending inside the cryostat. An electrically conductive rod is slidably disposed inside the tube. An electrically conductive terminal post with a transverse pin adapted to be engaged by the bayonet socket is mounted in the cryostat. Means external to the cryostat for rotating and slidably moving the tube to engage and disengage the socket with the terminal post are affixed to the tube. Means external to the cryostat are coupled to the rod and the tube for adjusting the relative displacement between the rod and the tube, so that the rod can be urged against the post after the socket engages the pin.

BRIEF DESCRIPTION OF THE DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description taken in conjunction with the accompanying drawing figures in which:

DETAILED DESCRIPTION OF THE INVENTION

Figure 1:
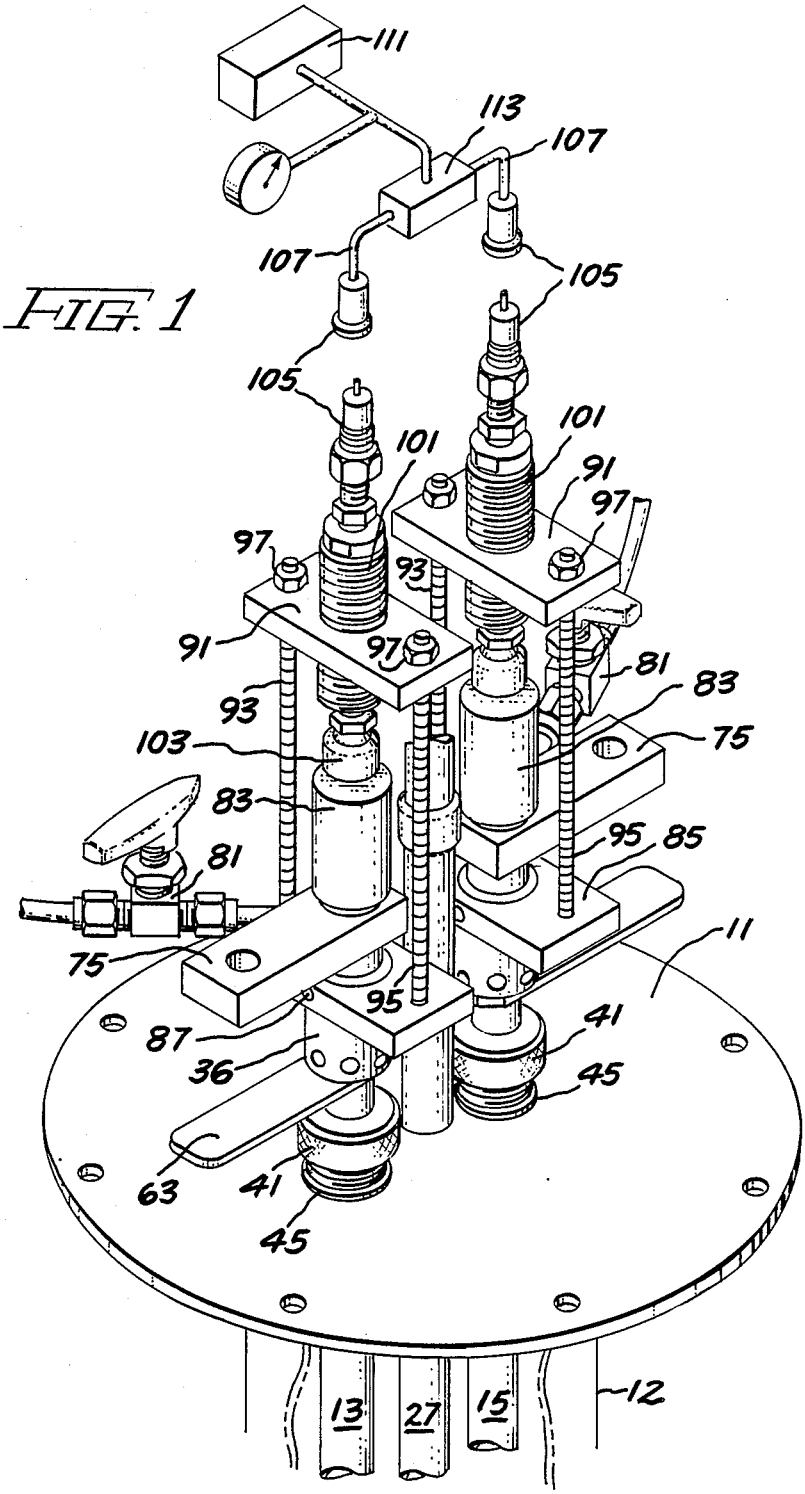
FIG. 1 is a partial isometric view of a hydraulically actuated cryogenic leads in accordance with the present invention.
Figure 2A:
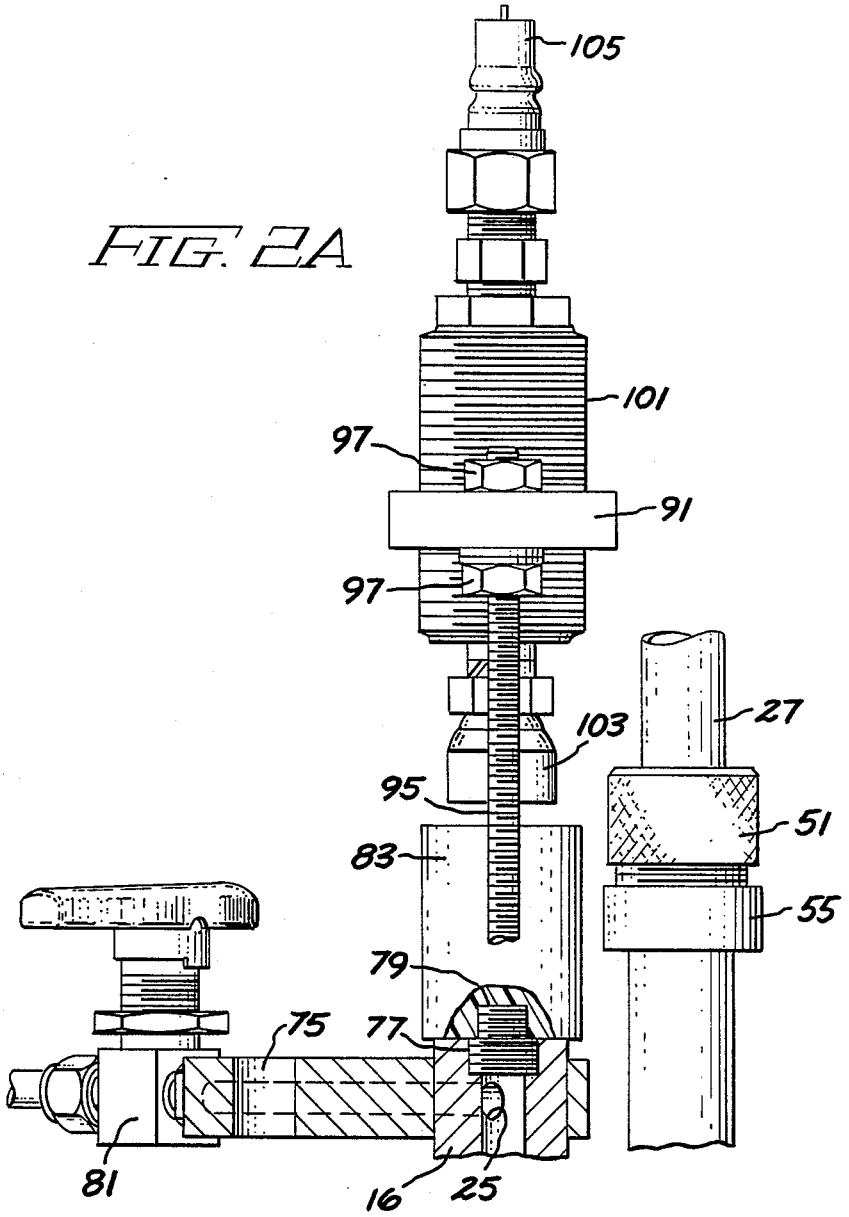
FIG. 2A and B are a partial side view partially in section of hydraulically actuated cryogenic leads in accordance with the present invention with FIG. 2A showing the upper portion and FIG. 2B showing the lower portion of FIG. 2.
Figure 2B:
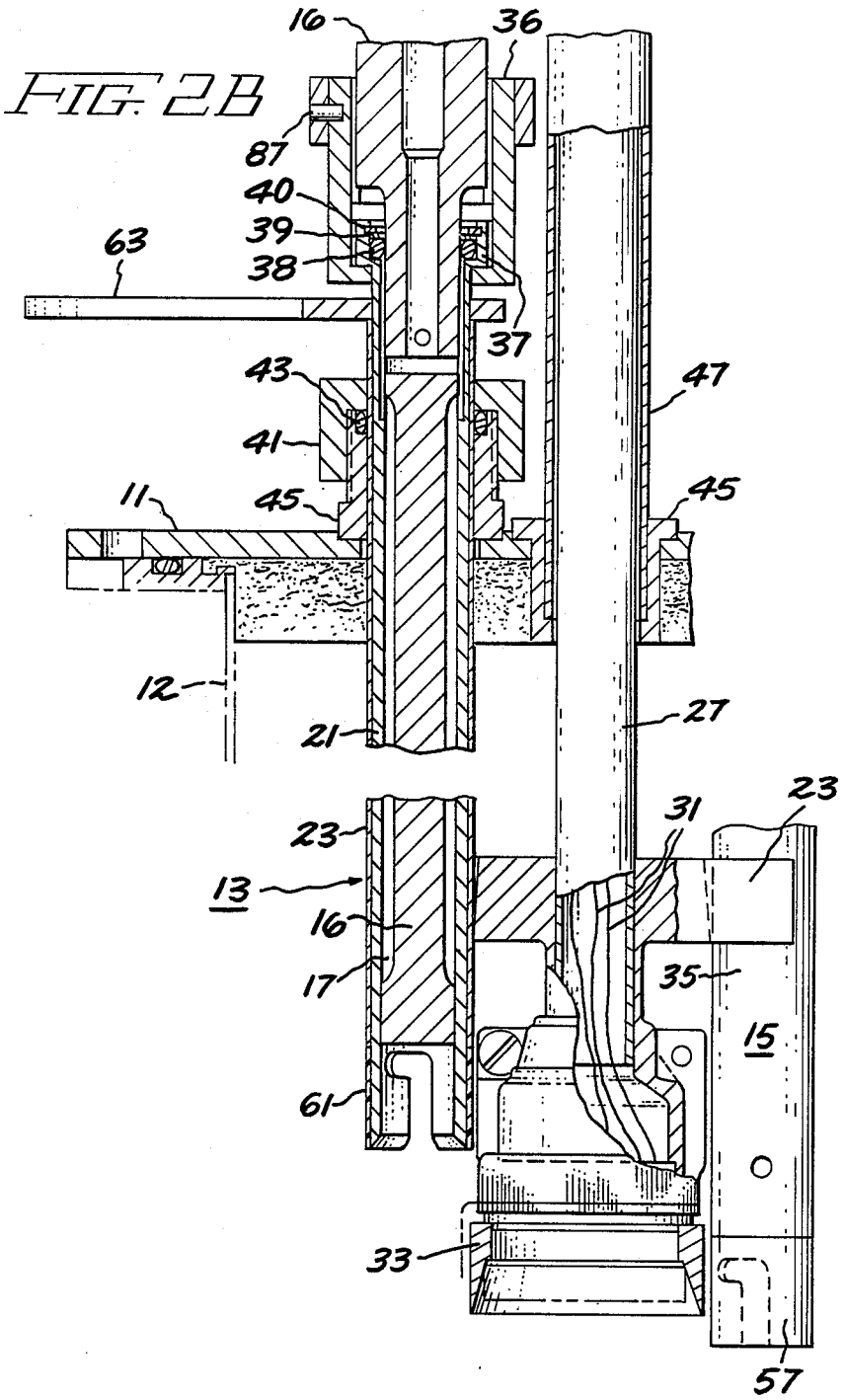

Referring now to the drawing wherein like references indicate like elements throughout, and particularly FIGS. 1 and 2, thereof, a hydraulically actuated retractable cryogenic lead assembly for providing power to the main windings of a superconducting magnet to establish current flow is shown. The assembly is designed to extend into a vertical service stack such as the one shown in U.S. Pat. No. 4,635,450. U.S. Pat. No. 4,635,450 is hereby incorporated by reference. A cover 11 of a vertical service stack of which only the innermost vessel 12 is shown, separate the internal from the external portion of the leads with the portion above the cover situated outside the service stack when the leads are installed on the cryostat of which the vertical stack is a part. The hydraulically actuated lead assembly comprises two power leads 13 and 15 each including a copper rod 16 with axial cooling slots 17 surrounded by a stainless steel tube 21 and insulated by a fiberglass sleeve 23 bonded on the outside surface of the stainless steel tube 21. The axial cooling slots are in flow communication with a vent 25 in the center of the copper rod portion that extends outside of the vertical stack. The retractable lead assembly also includes a conduit 27 containing a cable of wires 31 connected at the lower end to a multipin connector 33 located inside the insert and at the upper end to another multipin connector outside the insert (not shown). The retractable lead assembly has conduit 27 extending through the center of the vertical stack cover 11 with the power leads 13 and 15 extending through the vertical stack cover 11 on either side of conduit 27. The three leads 13, 15 and 27 are spaced apart inside the vertical stack by a horizontal guide bar 23. The conduit 27 passes through and is secured to, the guide bar 23. The two power leads 13 and 15 slide in tapered notches located on either end of the guide bar 23. The copper rods 16 inside of each of the power leads 13 and 15 slide relative to the surrounding stainless steel tube 21. Collars 36 comprise a cylindrical shell with a narrowed opening at one end, which provides a close fit around the stainless steel tubes. The collars are captured at the ends of each of the stainless steel tubes by a lead seal housing 37 secured to the end of the tubes such as by brazing. The lead seal housings 37 enlarge the diameters of the ends of the tubes and fit inside the collars. An internal "O" ring lead seal 38 is situated in each of the lead seal housings 37 surrounding copper rods 16 and in contact with the interior wall of the couplings 36. The seals are held in place by washers 39 and retaining rings 40. The copper rods 16 are therefore able to be rotated and slid inside the stainless steel tubes without the cryogen, vapor being vented escaping at the termination of the stainless steel tube. Collars 37 do not threadingly engage copper rods 16. Power leads 13 and 15 are each surrounded by a cap nut 41 which has an internal seal 43 which surrounds the power leads to allow the power leads to slide through the cover 11 without admitting air to the insert. Each of the cap nuts are threadingly engaged with a nipple 45 which is brazed to the cover. To allow sliding motion of the conduit 27, the conduit 27 extends through a pipe 47 soldered to the top of the cover and passes through a cap nut 51 which has an internal seal (not shown) which surrounds the conduit. Cap nut 51 is threadingly engaged with a nipple 55 which is brazed to pipe 47.

The bottom end of each of the power leads 13 and 15 has a bayonet socket 57 defined by the stainless steel tube 21. An additional stainless steel tube 61 surrounds the stainless steel tube 21 at the bottom of the tube 21 permitting the bayonet socket to have a double wall thickness to prevent bending of the socket as a result of the load transmitted to the socket when the bayonet socket is engaged. A lever 63 is affixed outside the service stack to each of the stainless steel tubes 21 of leads 13 and 15. Lever 63 is used to manipulate the bayonet sockets 57 to engage the pins 65 of the vertical terminal rods 71 shown in FIG. 3. The copper rods 16 extend through couplings 36 and the threaded end of each of the copper rods is brazed to a copper terminal 75 to which input current can be supplied from an external source (not shown). Threaded into an axially extending threaded aperture in the end of each of the copper rods is a threaded plug 77 having a threaded rod 79 brazed to it. The vent 25 in the copper rods for the axial cooling slots 17 extends through an aperture in each of the copper terminals 75 to valves 81. Two spacers 83 of low heat conductivity material, such as G-10 or textolite, each have a threaded opening which is threaded over each of the threaded rods 79 brazed to the plug 77 to hold the spacers on the ends of the copper rods 16. A first bar 85 having a central aperture and apertures spaced away from the central aperture on either side, is situated with the central aperture surrounding the collar 36. A pin 87 extending through the first bar and into the coupling holds the bar in place. A second bar 91 having a threaded central aperture and two apertures spaced away on either side is supported above the first bar on each of the two main leads by two threaded rods 93 and 95, respectively, serving as upright supports. Jam nuts 97 situated on each of the threaded rods above and below each of the bars hold the desired spaced apart relationship between the first and second bars. The threaded rods and bars can be fabricated using steel. One of the two hydraulic actuators 101 each containing a piston with a spring return, has a cylindrical body with exterior threads, which thread into each of the central aperture of the second bar. The end of the hydraulic actuator pistons each have swivel fitting 103 threaded in place to help align the end of the spacers 83 with the pistons. Quick disconnect couplings 105 are used to connect electrically non-conductive hydraulic fluid lines 107 to the hydraulic actuators. Hydraulic fluid is supplied by a pump 111 through a manifold 113 to supply the two hydraulic actuators 101 with equal pressure. The lower ends of the copper rods 16 are coated with a soft metal 115 such as indium, typically 0.010–0.020 inches thick. Correction coils (not shown) are connected to the retractable leads by pushing the conduit 27 into the stack 117 so that the tapered perimeter of the two halves of the multipin connectors 33 and 121, together with the keys and keyways on the multipin connectors assure an aligned joining of the male and female multipin connectors.

Figure 3:
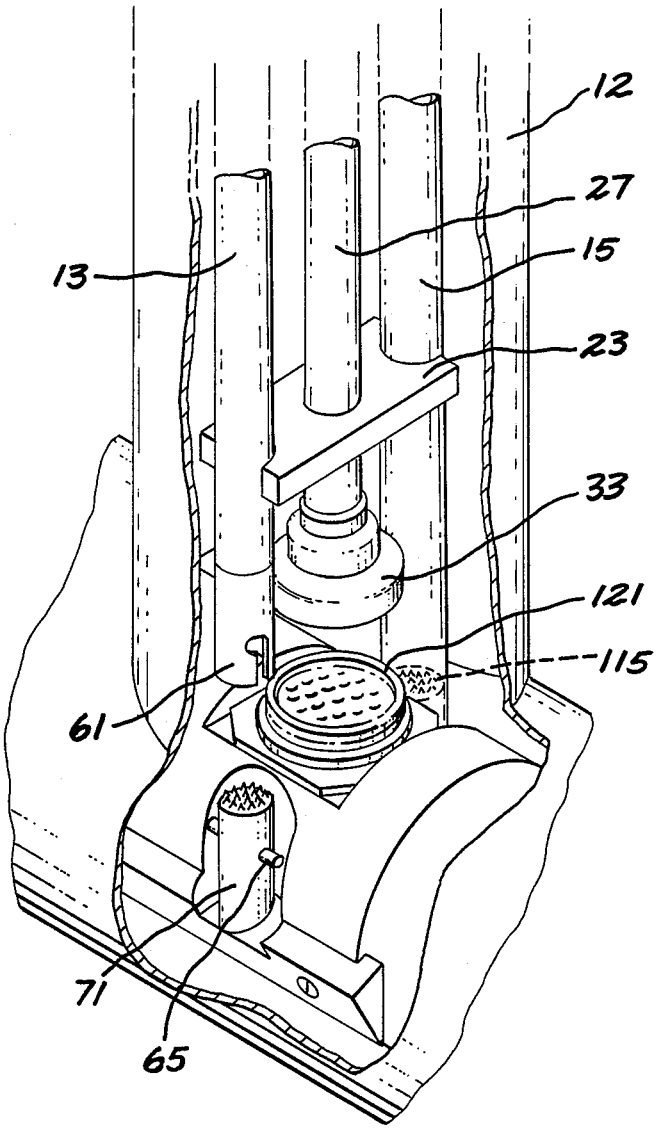
FIG. 3 is a partial side view of the terminals situated inside a vertical stack onto which the hydraulically actuated leads attach.

Referring now to FIGS. 1–3, to energize a magnet attached to terminals 123 in the inner vessel of the vertical stack 12, the electrical connections are made by lowering from the upper portion of the vertical stack the multipin connector 33 to engage its mating half 121. The power leads 13 and 15 are lowered and rotated by means of lever 63 to engage the horizontal pins 65 and in the vertical terminal rods 71. Hydraulic pressure is provided to actuators 101 which cause pistons to extend acting through spacers 83 and push copper rods 16 down the stainless steel tubes 21, with the soft indium metal at the bottom of the copper rods forced against the serrated tops of the vertical terminal rods forming a good electrical connection.

Increasing the hydraulic pressure provided to the actuators further, after the rods contacts the terminals, increases the force at the contact point in direct proportion to the hydraulic pressure. At this point after initial contact there is no relative motion between any of the main lead or hydraulic actuator components. Therefore, the force can be easily adjusted to a level required to achieve a low contact resistance despite the buildup of frost at the warm end of the vapor cooled leads. In addition, since the hydraulic pressure is not affected by the differential thermal contraction of the various main lead components as they are vapor-cooled, the contact force remains constant. The spacers 83 in addition to reducing heat loss from the interior of the vertical stack help prevents the hydraulic fluid from freezing during the current ramping cycle which can last up to 2½ hours. A power source (not shown) is connected to the copper terminals 75. During energization, helium vapor cooling is used to cool the copper rods by opening valves allowing vapor from the liquid cryogen in the cryostat to flow inside the stainless steel tube.

When power is supplied to the magnet windings via the terminals the main power leads are not superconductive and cryogen vapor cooling allows large current to be supplied to the windings in the cryostat while minimizing cryogen vapor loss and not permitting air to enter the cryostat. When the desired superconducting currents have been established the main power leads can be disconnected from outside the insert by relieving the hydraulic pressure supplied to the actuators. The piston is then automatically retracted approximately one half inch by a spring in the actuator. The lever can disengage the bayonet contacts and the contacts and the leads can then be withdrawn to the warmer top portion of the vertical stack to reduce conduction heat losses. Valves venting the copper rods are closed. The nonconductive hydraulic lines keep the two main leads from shorting. Similarly, the fiberglass sleeve surrounding the stainless steel tube also prevent shorting of the leads through the cover and the guide bar 35.

A hydraulic pressure of 250 lbs. supplied to a piston having an area of 0.25 $in^2$ which used contacts having an area of 0.14 $in^{-2}$ together in a liquid nitrogen bath 1.G resulted in contact resistances of less than 3 micro-ohms at 77° k even in the presence of frosting.

The foregoing has described a hydraulically actuated arrangement for high contact force electrical connections that can be operated by means of accessible, ambient temperature, mechanical components. The cryogenic leads can carry high currents and can make and break contact and still attain a low resistivity connection.

While the invention has been particularly shown and described with reference to a preferred embodiment thereof, it will be understood by those skilled in the art that various changes in form and detail may be made without departing from the spirit and scope of the invention.

What is claimed is:

1. Retractable cryogenic lead assembly for a cryostat having an aperture, said retractable lead assembly comprising:

a tube defining a bayonet socket at one end;

means for slidably and rotatably disposing said tube through the cryostat aperture, said tube extending inside and outside said cryostat with said bayonet socket end extending inside;

an electrically conductive rod slidably disposed inside said tube;

an electrically conductive terminal post mounted in said cryostat, said post having a transverse pin adapted to be engaged by said bayonet;

means affixed to said tube external to said cryostat for rotating and slidably moving said tube to engage and disengage said socket with said terminal post; and hydraulic means external to the cryostat, coupled to said rod and said tube for adjusting the relative displacement between said rod and said tube, so that the rod can be urged against said post after said socket engages said pin.

2. The apparatus of claim 1 wherein said hydraulic means for adjusting the relative displacement between said rod and said tube comprises hydraulic actuator having a housing and a piston slidably situated therein and said housing secured to said tube, said piston when extended urging said rod against said post.

3. The apparatus of claim 2, further comprising a thermally insulating spacer secured to the end of said rod, said piston when extended acting against said spacer.

4. The apparatus of claim 3 wherein said conductive rod has longitudinally extending slots on its outside surface creating a vapor cooling path from inside the service stack to outside the service stack.

5. The apparatus of claim 4 wherein the end of said rod has a coating of indium and said post has a serrated top.

6. Retractable cryogenic lead assembly for a cryostat vertical service stack having a cover, the cover defining an aperture, said retractable cryogenic lead assembly comprising:

a tube defining a bayonet socket at its lower end;

means for slidably rotatably disposing said tube through the cover aperture, said tube extending inside and outside said vertical stack with said bayonet socket end extending inside;

an electrically conductive rod slidably disposed inside said tube;

an electrically conductive terminal post mounted in said stack, said post having a transverse pin adapted to be engaged by said bayonet socket;

means affixed to said tube external to said cryostat for rotating and slidably moving said tube to engage and disengage said socket with said terminal post; and hydraulic means external to the cryostat, coupled to said rod and said tube for adjusting the relative displacement between said rod and said tube, so that the rod can be urged against said post when said socket engages said pin.

7. The apparatus of claim 6 wherein said hydraulic means for adjusting the relative displacement between said rod and said tube comprises a hydraulic actuator having a housing and a piston slidably situated therein said housing secured to said tube, said piston when extended urging said rod against said post.

8. The apparatus of claim 7, further comprising a thermally insulating spacer secured to the end of said rod, said piston when extended acting against said spacer.

9. The apparatus of claim 8 wherein said conductive rod has longitudinally extending slots on its outside surface creating a vapor cooling path from inside the service stack to outside the service stack.

10. The apparatus of claim 9 wherein the end of said rod has a coating of indium and said post has a serrated top.

* * * * *